US011749200B1

(12) United States Patent
Yuan et al.

(10) Patent No.: US 11,749,200 B1
(45) Date of Patent: Sep. 5, 2023

(54) DISPLAY DRIVING CIRCUIT AND DISPLAY DEVICE

(71) Applicants: MIANYANG HKC OPTOELECTRONICS TECHNOLOGY CO., LTD., Mianyang (CN); HKC CORPORATION LIMITED, Shenzhen (CN)

(72) Inventors: Xin Yuan, Mianyang (CN); Xiufeng Zhou, Mianyang (CN); Rongrong Li, Mianyang (CN)

(73) Assignees: MIANYANG HKC OPTOELECTRONICS TECHNOLOGY CO., LTD., Mianyang (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/088,793

(22) Filed: Dec. 27, 2022

(30) Foreign Application Priority Data

Jun. 27, 2022 (CN) ..... 202210744021.9

(51) Int. Cl.
*G09G 3/3241* (2016.01)
*G09G 3/3258* (2016.01)

(52) U.S. Cl.
CPC ..... *G09G 3/3241* (2013.01); *G09G 3/3258* (2013.01); *G09G 2300/0804* (2013.01)

(58) Field of Classification Search
None
See application file for complete search history.

(56) References Cited

U.S. PATENT DOCUMENTS 6,522,079 B1 2/2003 Yamada
2012/0026144 A1 2/2012 Kang et al.
(Continued)

FOREIGN PATENT DOCUMENTS

CN 101038728 A 9/2007
CN 101561992 A 10/2009
(Continued)

OTHER PUBLICATIONS

Chinese First Office Action,Chinese Application No. 202210744021.9, dated Feb. 27, 2023 (17 pages).
(Continued)

*Primary Examiner* — Nicholas J Lee

(57) ABSTRACT

The present disclosure provides a display driving circuit and a display device. The display driving circuit includes multiple pixel circuits. A data terminal of each pixel circuit is connected to a corresponding data line. A scanning gate terminal of each pixel circuit is connected to a corresponding gate line. Power-supply terminals of N1 pixel circuits of the pixel circuits are all connected to a same first common line. N1 is greater than 2 and not greater than a first common number. The first common number is negatively correlated to any of a characteristic parameter of a thin-film field-effect transistor of each pixel circuit, and a current in one of the N1 pixel circuits, and a resistance of a power-supply voltage signal line between adjacent pixel circuits in the N1 pixel circuits, and the characteristic parameter is positively correlated to a channel width-to-length ratio of the thin-film field-effect transistor.

20 Claims, 2 Drawing Sheets

(56) References Cited

U.S. PATENT DOCUMENTS

| | | | | |
|---|---|---|---|---|
| 2013/0181967 | A1* | 7/2013 | Lee | G09G 3/3258 345/212 |
| 2022/0208124 | A1* | 6/2022 | Choi | H10K 59/131 |

FOREIGN PATENT DOCUMENTS

| | | | |
|---|---|---|---|
| CN | 101894860 | A | 11/2010 |
| CN | 103002624 | A | 3/2013 |
| CN | 103208253 | A | 7/2013 |
| CN | 104659061 | A | 5/2015 |
| CN | 107148646 | A | 9/2017 |
| CN | 108389880 | A | 8/2018 |
| CN | 110503917 | A | 11/2019 |
| CN | 110956929 | A | 4/2020 |
| CN | 115132139 | A | 9/2022 |
| CN | 115240585 | A | 10/2022 |
| CN | 115240586 | A | 10/2022 |
| JP | 2007047329 | A | 2/2007 |
| JP | 2010019944 | A | 1/2010 |
| TW | M625256 | U | 4/2022 |

OTHER PUBLICATIONS

International Search Report,International Application No. PCT/CN2022/136626, dated Feb. 22, 2023 (16 pages).

* cited by examiner

DISPLAY DRIVING CIRCUIT AND DISPLAY DEVICE

CROSS REFERENCE

The present application claims priority of Chinese Patent Application No. 202210744021.9, filed on Jun. 27, 2022, the entire contents of which are hereby incorporated by reference in its entirety.

TECHNICAL FIELD

The present disclosure relates to the field of display technologies, and in particular to a display driving circuit and a display device.

BACKGROUND

In the related art, multiple pixel circuits are usually required in a display device. For example, several pixel circuits including OLEDs may usually be arranged in an OLED (Organic Light-Emitting Diode) display device. The several pixel circuits are arranged in an array, and a power-supply terminal of each of the pixel circuits is connected to a power line to receive a power-supply signal. Power lines connected to different pixel circuits are different.

The drawback of the related art includes that, due to each of the pixel circuits being connected to a separate power line, the number of power lines in the display device is great, and an alignment of the power lines is complicated, resulting in more parasitic capacitance between the power lines and more serious signal interference between the power lines. Further, it is easy for the power lines to occupy too much space, so as to make greater limitations on a circuit design in the display device. Therefore, due to the above factors, display effects of existing display devices are poor.

SUMMARY OF THE DISCLOSURE

The present disclosure provides a display driving circuit and a display device.

A first technical solution proposed by the present disclosure is: a display driving circuit, including a plurality of pixel circuits; wherein a data terminal of each of the pixel circuits is connected to a corresponding data line, the data line is configured to provide a data signal; a scanning gate terminal of each of the pixel circuits is connected to a corresponding gate line, the gate line is configured to provide a gate signal; power-supply terminals of N1 pixel circuits of the pixel circuits are all connected to a same first common line, the first common line is configured to provide a power-supply voltage signal, and N1 is greater than 2 and not greater than a first common number; wherein the first common number is negatively correlated to any of a characteristic parameter of a thin-film field-effect transistor of each of the pixel circuits, and a current in one of the N1 pixel circuits, and a resistance of a power-supply voltage signal line between adjacent pixel circuits in the N1 pixel circuits, and the characteristic parameter of the thin-film field-effect transistor is positively correlated to a channel width-to-length ratio of the thin-film field-effect transistor.

A second technical solution proposed by the present disclosure is: a display device, including a light-emitting display device and the display driving circuit as above.

BRIEF DESCRIPTION OF THE DRAWINGS

In order to more clearly illustrate the technical solutions in the embodiments of the present disclosure, the following is a brief description of the drawings required for the description of the embodiments, and it will be obvious that the drawings in the following description are only some embodiments of the present disclosure, and that other drawings can be obtained from these drawings without creative work for those skilled in the art.

Figure 1:
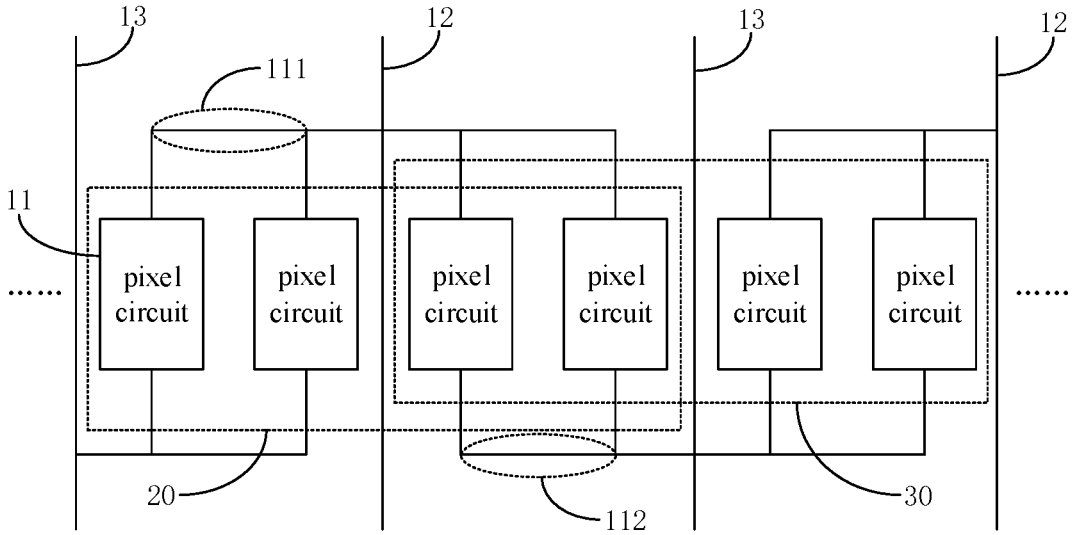
FIG. 1 is a structural schematic view of a display driving circuit according to an embodiment of the present disclosure.

Accompany drawings reference: pixel circuit 11, power-supply voltage signal line 111, initialization signal line 112, first common line 12, second common line 13, first pixel circuit set 20, second pixel circuit set 30, first light-emitting control circuit 41, driving circuit 42, second light-emitting control circuit 43, switch circuit 44, storage circuit 45, initialization circuit 46, data-writing circuit 47, light-emitting circuit 48, thin-film field-effect transistor 49, display device 50, light-emitting display device 51, display driving circuit 52.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure all other embodiments obtained by a person of ordinary skill in the art without creative labor fall within the scope of protection of the present disclosure.

The terms "first" and "second" in the present disclosure are used for descriptive purposes only, and are not to be construed as indicating or implying relative importance or implicitly specifying the number of technical features indicated. In the description of this application, "plurality" means at least two, such as two, three, etc., unless otherwise expressly and specifically limited. In addition, the terms "including" and "having", and any variations thereof, are intended to cover non-exclusive inclusion. For example, a process, method, system, product or apparatus comprising a series of steps or units is not limited to the listed steps or units, but optionally also includes steps or units that are not listed, or optionally also includes other steps or units that are inherent to those processes, methods, products or apparatus.

The plurality of pixel circuits in the display device mentioned in the present disclosure is firstly described by way of example.

Figure 4:
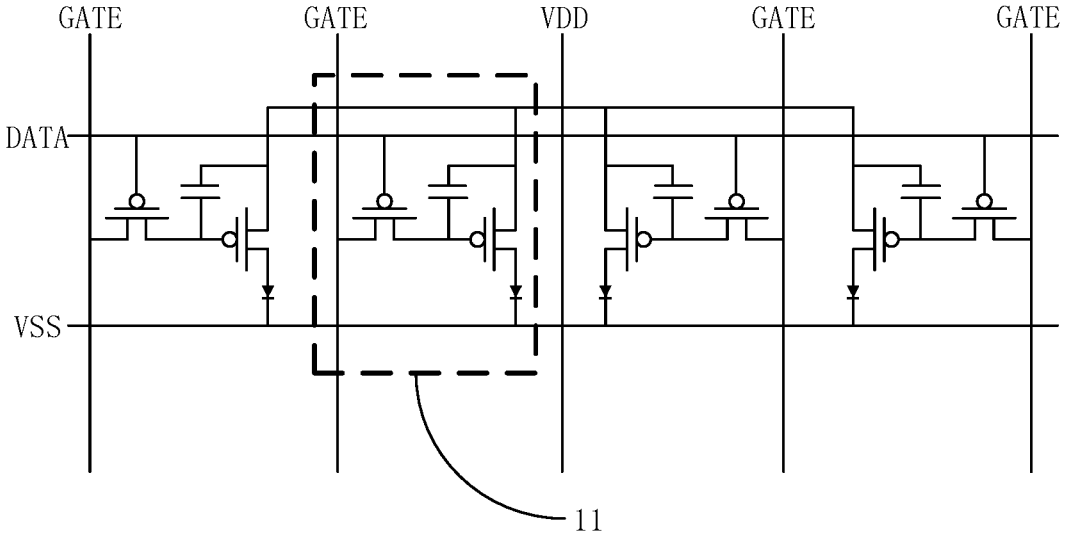
FIG. 4 is a structural schematic view of the display driving circuit according to an embodiment of the present disclosure.

The plurality of pixel circuits in the display device mentioned in the present disclosure is first described by way of example. The display driving circuit in the present disclosure may include a plurality of pixel circuits consisting of "2T1C pixel circuits". As shown in FIG. 4, FIG. 4 is a structural schematic view of a display driving circuit according to an embodiment of the present disclosure. The display driving circuit includes a plurality of pixel circuits 11, and each pixel circuit 11 includes two thin-film field-effect transistors and a capacitor; a power-supply terminal of each pixel circuit 11 is connected to a same power-supply common line (VDD), and each pixel circuit 11 is connected to a negative power-supply line (VSS), a data line (DATA), and a gate line (GATE). Based on the above arrangement, the display driving circuit 10 in which multiple pixel circuits 11 are connected to the same power supply common line can be constructed, which is a basic construction of the display driving circuit in the subsequent descriptions of the present disclosure.

In addition, the pixel circuits in the display driving circuit of this application can be other types of pixel circuits than the "2T1C pixel circuit", depending on actual needs, which is not limited herein.

The present disclosure first proposes a display driving circuit, as shown in FIG. 1, FIG. 1 is a structural schematic view of a display driving circuit according to an embodiment of the present disclosure. The display driving circuit includes a plurality of pixel circuits 11.

A data terminal of each of the pixel circuits 11 is connected to a corresponding data line, the data line is configured to provide a data signal. A scanning gate terminal of each of the pixel circuits 11 is connected to a corresponding gate line, the gate line is configured to provide a gate signal.

Power-supply terminals of N1 pixel circuits of the pixel circuits 11 are all connected to a same first common line, to receive a power-supply voltage signal provided by the first common line, and N1 is greater than 2 and not greater than a first common number.

The first common number is negatively correlated to any of a characteristic parameter of a thin-film field-effect transistor of each of the pixel circuits 11, and a current in one of the N1 pixel circuits 11, and a resistance of a power-supply voltage signal line between adjacent pixel circuits 11 in the N1 pixel circuits 11, and the characteristic parameter of the thin-film field-effect transistor is positively correlated to a channel width-to-length ratio of the thin-film field-effect transistor. Based on the above positive correlation and the above negative correlation, the first common number may always be adapted to actual situations of the display driving circuit.

Specifically, as shown in FIG. 1, the first pixel circuit set 20 may include the N1 pixel circuits mentioned above, and each of the pixel circuits 11 in the display driving circuit of the display device generally belongs to a same specification. That is, the characteristic parameter of the thin-film field-effect transistor corresponding to each of the plurality of pixel circuits 11, the resistance of the power-supply voltage signal line between adjacent pixel circuits 11 in the plurality of pixel circuits 11, and the current in one of the plurality of pixel circuits 11 are the same or may be regarded to be the same. Therefore, the first common number may be determined based on the characteristic parameter of the thin-film field-effect transistor and the current corresponding to any of the pixel circuits 11, and the resistance of the power-supply voltage signal line between any two adjacent pixel circuits 11 by means of a calculating manner of the first common number.

The pixel circuit may be an OLED pixel circuit or other types of pixel circuits, depending on the actual needs, which is not limited herein. In practice, a layer of a metal span wire may be added on a basis of a conventional pixel circuit and configured to be connected to the first common line. The pixel circuits may be connected to the first common line by other means, without limitation herein.

Based on the above manner, the maximum number of the pixel circuits 11 sharing the same first common line (i.e., the first common number mentioned above) may be determined based on related data between pixel circuits 11 in the display driving circuit, and the number of the N1 pixel circuits 11 is configured to be not greater than the maximum number, such that total resistances of connecting lines between each of the N1 pixel circuits 11 and the power-supply voltage signal line 111 have a less difference. In this way, uniformity of an amplitude of the power-supply voltage signal received by each of the N1 pixel circuits 11 may be increased, and the display effect of the display module including the display driving circuit may be improved.

Different from the related art, in the technical solutions of the present disclosure, the plurality of pixel circuits are arranged with the N1 pixel circuits sharing the same first common line to receive the power-supply voltage signal, so as to reduce the number of first common lines in the display device, a complexity of arranging lines, and the parasitic capacitance between the lines. Further, the signal interference between the lines and the space occupied by the lines are reduced. In addition, since the first common number is negatively correlated to any of the characteristic parameter of the thin-film field-effect transistor of each of the pixel circuits, and the current in one of the N1 pixel circuits, and the resistance of the power-supply voltage signal line between the adjacent pixel circuits in the N1 pixel circuits, and the characteristic parameter of the thin-film field-effect transistor is positively correlated to the channel width-to-length ratio of the thin-film field-effect transistor, the first common number may be determined based on the above correlations. N1 is greater than 2 and not greater than the first common number, so as to avoid an occurrence of a pixel circuit having a greater difference in a length of a line configured to be connected to the same first common line from the other pixel circuits, in the pixel circuits connected to the same first common line. A greater difference in a resistance of the line due to the greater difference in the length of the line, which results in non-uniformity of the power-supply voltage signal received by each of the N1 pixel circuits 11, may be further avoided. In this way, in the present disclosure, the number of the first common lines is reduced and other negative effects caused by reducing the number of the first common lines are avoided, improving the display effect of the display device.

In an embodiment, the characteristic parameter of the thin-film field-effect transistor of each of the pixel circuits 11 is positively correlated to a mobility of the thin-film field-effect transistor and a construction capacitance of the thin-film field-effect transistor, respectively.

Specifically, according to the above correlations, the greater the channel width-to-length ratio of the thin-film field-effect transistor is, the greater the corresponding characteristic parameter of the thin-film field-effect transistor is. The greater the mobility of the thin-film field-effect transistor is, the greater corresponding characteristic parameter of the thin-film field-effect transistor is. The greater the construction capacitance of the thin-film field-effect transistor is, the greater the corresponding characteristic parameter of the thin-film field-effect transistor is.

Based on the above manner, a magnitude of the characteristic parameter of the thin-film field-effect transistor of each of the pixel circuits may be further accurately determined, which may improve a rationality of the first common number, so as to further improve the display effect of the display device.

In some embodiments, the characteristic parameter of the thin-film field-effect transistor is a quotient obtained by dividing a fourth value by a length of a channel of the thin-film field-effect transistor, and the fourth value is a product of the mobility of the thin-film field-effect transistor, a width of a channel of the thin-film field-effect transistor, and the construction capacitance of the thin-film field-effect transistor.

Specifically, a TFT (Thin Film Transistor) is usually provided in each of the pixel circuits 11. The mobility, the width of the channel, and the length of the channel of the TFT of any of the pixel circuits 11 may be obtained, and a capacitance value of a capacitance constructed by a metal layer, an insulating layer, and an active layer in the TFT may be obtained and denoted as the construction capacitance.

Based on the above manner, a characteristic parameter of the TFT may be determined based on each parameter of the TFT of each of the pixel circuits 11, such that the first common number described above may be further determined based on the characteristic parameter. In this way, the uniformity of the amplitude of the power-supply voltage signal received by each of the N1 pixel circuits 11 may be improved, and the display effect of the display device may be improved.

In an embodiment, the first common number is a quarter power of a first value, the first value is a quotient obtained by dividing a first preset constant by a second value, the second value is a product of the characteristic parameter of the thin-film field-effect transistor of each of the pixel circuits and a third value, and the third value is a quadratic of a product of the resistance of the power-supply voltage signal line between the adjacent pixel circuits in the plurality of pixel circuits and the current of the pixel circuit.

Based on the above manner, the first common number may be obtained in combination with related parameters of each of the pixel circuits 11 in the display driving circuit.

In some embodiments, the first common number may be a value determined based on a first calculating process.

The first calculating process includes the following.

The mobility is multiplied by the width, divided by the length, and multiplied by the construction capacitance, and the first value is obtained.

The current of one of the pixel circuits is multiplied by the resistance of the power-supply voltage signal line between the adjacent pixel circuits, and a second value is obtained.

A square of the second value is multiplied by the first value and the third value is obtained.

A preset constant is divided by the third value and the fourth value is obtained.

The fourth value is squared four times and the first common number is obtained.

Specifically, the first value is the characteristic parameter of the thin-film field-effect transistor.

Alternatively, the first calculating process may be expressed by a first calculation formula. That is, the first common number is a value determined based on a first calculation formula, and the first calculation formula is:

$$\begin{cases} n_1 = \left(\dfrac{H_1}{k \times (I \times R_1)^2}\right)^{\frac{1}{4}} \\ k = \mu \times \dfrac{W}{L} \times C \end{cases} \quad (1)$$

In the formula (1), $n_1$ is the first common number, $H_1$ is the first preset constant, k is the characteristic parameter of the thin-film field-effect transistor, $R_1$ is the resistance of the power-supply voltage signal line between the adjacent pixel circuits in the plurality of pixel circuits, μ is the mobility of the thin-film field-effect transistor, W is the width of the channel of the thin-film field-effect transistor, L is the length of the channel of the thin-film field-effect transistor, and C is the construction capacitance of the thin-film field-effect transistor.

Based on the above manner, a more reasonable first common number may be calculated based on the first calculating process or the first calculation formula, with each parameter mentioned above, which is configured to limit the number of pixel circuits 11 in the N1 pixel circuits 11, improving the display effect of the display device.

In an embodiment, the first preset constant is positively correlated to the current of each of the pixel circuits 11, and is negatively correlated to a current fluctuation value between the adjacent pixel circuits. Specifically, the current fluctuation value between the adjacent pixel circuits is a current difference value between the adjacent pixel circuits 11. To ensure uniformity of a luminance displayed by each of the pixel circuits in the display device, the current difference is usually limited to 2%-3% of the current in the pixel circuit 11.

In another example, the first preset constant may be specifically within a first preset constant range which may be determined based on actual operating hardware conditions and/or operating environment conditions of the display device. For example, the first preset constant range may be 0.08-0.12 or in other ranges, which is not limited herein.

In an embodiment, receiving terminals of an initialization signal of N2 pixel circuits of the plurality of pixel circuits 11 are all connected to a same second common line, and are configured to receive the initialization signal provided by the same second common line. N2 is greater than 2 and not greater than a second common number.

The second common number is negatively correlated to any of the characteristic parameter of the thin-film field-effect transistor of each of the pixel circuits 11, and a current in one of the N2 pixel circuits 11, and a resistance of a initialization signal line between adjacent pixel circuits 11 in the N2 pixel circuits 11, and the characteristic parameter of the thin-film field-effect transistor is positively correlated to the channel width-to-length ratio of the thin-film field-effect transistor. Based on the above positive correlation and the above negative correlation, the second common number may always be adapted to the actual situations of the display driving circuit.

Specifically, as shown in FIG. 1, the second pixel circuit set 30 may include the N2 pixel circuits mentioned above, and each of the pixel circuits 11 in the display driving circuit of the display device generally belongs to the same specification. That is, the characteristic parameter of the thin-film field-effect transistor corresponding to each of the plurality of pixel circuits 11, the resistance of the initialization signal line between the adjacent pixel circuits 11 in the plurality of pixel circuits 11, and the current in one of the plurality of pixel circuits 11 are the same or may be regarded to be the same. Therefore, the second common number may be determined based on the characteristic parameter of the thin-film field-effect transistor and the current corresponding to any of the pixel circuits 11, and the resistance of the initialization signal line between the adjacent pixel circuits 11 in the plurality of pixel circuits 11, by means of a calculating manner of the second common number.

Based on the above manner, the maximum number of the pixel circuits 11 sharing the same second common line (i.e., the second common number mentioned above) may be determined based on related data of the pixel circuit and the related data between the adjacent pixel circuits 11 in the display driving circuit, and the number of the N2 pixel circuits 11 is configured to be not greater than the maximum number, such that total resistances of connecting lines between each of the N2 pixel circuits 11 and the initiation signal line 112 have a less difference. In this way, uniformity of an amplitude of an initiation signal received by each of the N2 pixel circuits 11 may be increased. In this way, an initialization process is performed for each of the pixel circuits 11 based on the initialization signal, and an initialization process result of each of the pixel circuits 11 may keep consistent, which improves the display effect of the display device including the display driver circuit.

It should be noted that the first pixel circuit set 20 and the second pixel circuit set 30 may include identical pixel circuits, or may also include completely different or partially identical pixel circuits. That is, the plurality of pixel circuits 11 connected to the same first common line may all be connected to the same second common line, or partially connected to the same second common line, or may be all connected to different second common lines. For example, as shown in FIG. 1, the pixel circuits 11 can be connected to the same second common line. For example, as shown in FIG. 1, only two of the pixel circuits 11 in the first pixel circuit set 20 and the second pixel circuit set 30 are connected to both the same first common line 12 and to the same second common line 13 simultaneously.

In an embodiment, the characteristic parameter of the thin-film field-effect transistor of each of the pixel circuits 11 is positively correlated to the mobility of the thin-film field-effect transistor and the construction capacitance of the thin-film field-effect transistor, respectively.

Specifically, according to the above correlations, the greater the channel width-to-length ratio of the thin-film field-effect transistor is, the greater the corresponding characteristic parameter of the thin-film field-effect transistor is. The greater the mobility of the thin-film field-effect transistor is, the greater corresponding characteristic parameter of the thin-film field-effect transistor is. The greater the construction capacitance of the thin-film field-effect transistor is, the greater the corresponding characteristic parameter of the thin-film field-effect transistor is.

Based on the above manner, the magnitude of the characteristic parameter of the thin-film field-effect transistor of each of the pixel circuits may be further accurately determined, which may improve a rationality of the second common number, so as to further improve the display effect of the display device.

In some embodiments, the characteristic parameter of the thin-film field-effect transistor is the quotient obtained by dividing the fourth value by the length of the channel of the thin-film field-effect transistor, and the fourth value is the product of the mobility of the thin-film field-effect transistor, the width of the channel of the thin-film field-effect transistor, and the construction capacitance of the thin-film field-effect transistor.

Specifically, the TFT is usually provided in each of the pixel circuits 11. The mobility, the width of the channel, and the length of the channel of the TFT of any of the pixel circuits 11 may be obtained, and the capacitance value of the capacitance constructed by the metal layer, the insulating layer, and the active layer in the TFT may be obtained and denoted as the construction capacitance.

Based on the above manner, the characteristic parameter of the TFT may be determined based on each parameter of the TFT of each of the pixel circuits 11, such that the second common number described above may be further determined based on the characteristic parameter. In this way, the uniformity of the amplitude of the initiation signal received by each of the pixel circuits 11 may be improved, and the display effect of the display device may be improved.

In an embodiment, the second common number is a quarter power of a fifth value, the fifth value is a quotient obtained by dividing a second preset constant by a sixth value, the sixth value is a product of the characteristic parameter of the thin-film field-effect transistor of each of the pixel circuits and a seventh value, and the seventh value is a quadratic of a product of the resistance of the initiation signal line between the adjacent pixel circuits in the plurality of pixel circuits and the current of the pixel circuit.

Based on the above manner, the second common number may be obtained in combination with related parameters of each of the pixel circuits 11 in the display driving circuit.

In some embodiments, the second common number may be a value determined based on a second calculating process.

Further, the second calculating process includes the following.

The mobility is multiplied by the width, divided by the length, and multiplied by the construction capacitance, and the fifth value is obtained.

The current of one of the pixel circuits is multiplied by the resistance of the initiation signal line between the adjacent pixel circuits, and a sixth value is obtained.

A square of the sixth value is multiplied by the fifth value and the seventh value is obtained.

A preset constant is divided by the seventh value and the eighth value is obtained.

The eighth value is squared four times and the second common number is obtained.

Specifically, the fifth value is the characteristic parameter of the thin-film field-effect transistor.

Alternatively, the second calculating process may be expressed by a second calculation formula. That is, the second common number is a value determined based on the second calculation formula, and the second calculation formula is:

$$\begin{cases} n_2 = \left(\dfrac{H_2}{k \times (I \times R_2)^2}\right)^{\frac{1}{4}} \\ k = \mu \times \dfrac{W}{L} \times C \end{cases} \tag{2}$$

In the formula (2), $n_2$ is the second common number, $H_2$ is the second preset constant, k is the characteristic parameter of the thin-film field-effect transistor, $R_2$ is the resistance of the initiation signal line between the adjacent pixel circuits in the plurality of pixel circuits, μ is a mobility of the thin-film field-effect transistor, W is the width of the channel of the thin-film field-effect transistor, L is the length of the channel of the thin-film field-effect transistor, and C is the construction capacitance of the thin-film field-effect transistor.

Based on the above manner, a more reasonable second common number may be calculated based on the second calculating process or the second calculation formula, with each parameter mentioned above, which is configured to limit the number of pixel circuits 11 in the N2 pixel circuits 11, improving the display effect of the display device.

In an embodiment, the second preset constant is positively correlated to the current of each of the pixel circuits 11, and is negatively correlated to a current fluctuation value between the adjacent pixel circuits. Specifically, the current fluctuation value between the adjacent pixel circuits is the current difference value between the adjacent pixel circuits 11. To ensure the uniformity of the luminance displayed by each of the pixel circuits in the display device, the current difference is usually limited to 2%-3% of the current in the pixel circuit 11.

In another example, the second preset constant may be specifically within a second preset constant range which may be determined based on the actual operating hardware conditions and/or the operating environment conditions of the display device. For example, the second preset constant range may be 0.08-0.12 or in other ranges, which is not limited herein.

Figure 2:
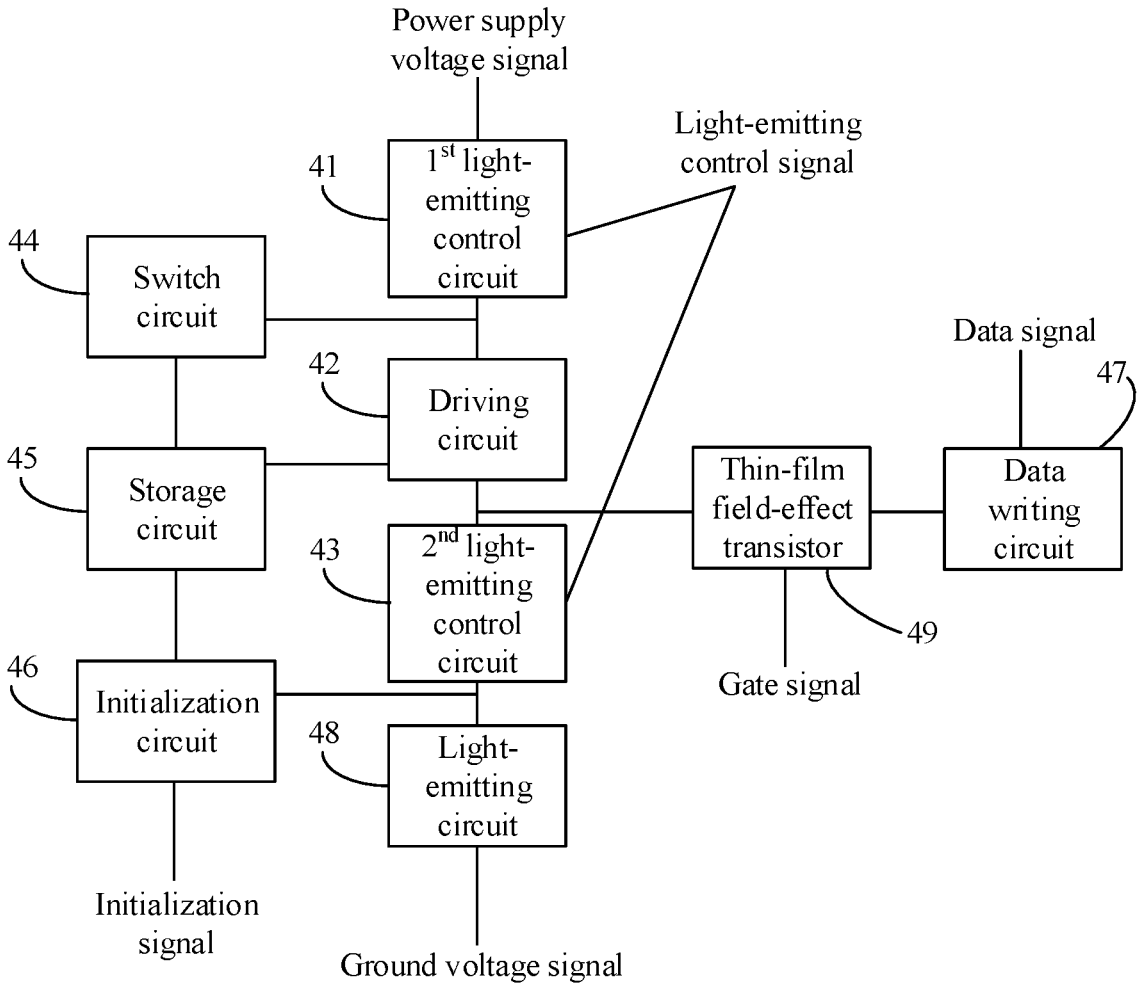
FIG. 2 is a structural schematic view of a pixel circuit according to an embodiment of the present disclosure.

In an embodiment, as shown in FIG. 2, FIG. 2 is a structural schematic view of a pixel circuit according to an embodiment of the present disclosure. The pixel circuit 11 includes a first light-emitting control circuit 41, a driving circuit 42, a second light-emitting control circuit 43, a switch circuit 44, a storage circuit 45, an initialization circuit 46, a data-writing circuit 47, and a light-emitting circuit 48.

An input terminal of the data-writing circuit 47 is configured to receive a data signal, and an output terminal of the data-writing circuit 47 is connected to an input terminal of the second light-emitting control circuit 43. An input terminal of the first light-emitting control circuit 41 is configured to receive a power-supply voltage signal, and an output terminal of the first light-emitting control circuit 41 is connected to an input terminal of the driving circuit 42. An output terminal of the driving circuit 42 is connected to the input terminal of the second light-emitting control circuit 43. An output terminal of the second light-emitting control circuit 43 is connected to an input terminal of the light-emitting circuit 48, and an output terminal of the light-emitting circuit 48 is configured to receive a ground voltage signal. An input terminal of the initialization circuit 46 is configured to receive the initialization signal, a first output terminal of the initialization circuit 46 is connected to an input terminal of the storage circuit 45, and a second output terminal of the initialization circuit 46 is connected to the input terminal of the light-emitting circuit 48. A first output terminal of the storage circuit 45 is connected to an input terminal of the switch circuit 44, a second output terminal of the storage circuit 45 is connected to a driving terminal of the driving circuit 42, and an output terminal of the switch circuit 44 is connected to the input terminal of the driving circuit 42.

In some embodiments, as shown in FIG. 2, the pixel circuit 11 also includes a thin-film field-effect transistor 49.

The output terminal of the data-writing circuit 47 is connected to a first terminal of the thin-film field-effect transistor 49. A second terminal of the thin-film field-effect transistor 49 is connected to the input terminal of the second light-emitting control circuit 43, and a driving terminal of the thin-film field-effect transistor 49 is configured to receive a gate signal. Both a driving terminal of the first light-emitting control circuit 41 and a driving terminal of the second light-emitting control circuit 43 are configured to receive a light-emitting control signal.

Figure 3:
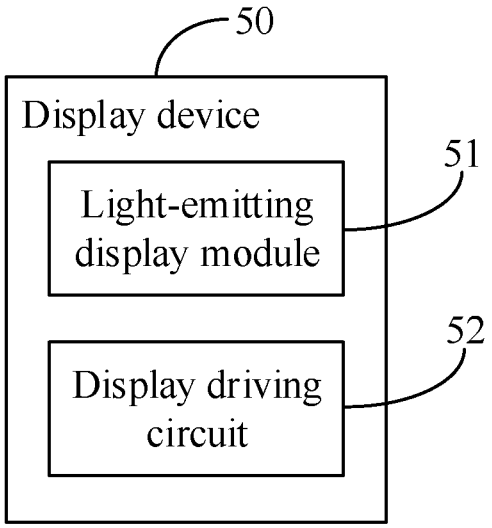
FIG. 3 is a structural schematic view of a display device according to an embodiment of the present disclosure.

The present disclosure further proposes a display device. As shown in FIG. 3, FIG. 3 is a structural schematic view of a display device according to an embodiment of the present disclosure. The display device 50 includes a light-emitting display device 51 and a display driving circuit 52. The display driving circuit 52 may be the display driving circuit in any of the previous embodiments, which will not be repeated herein.

The display device may be an in-vehicle display device, or a television, or a mobile terminal display, or other types of display devices, without limitation herein.

Different from the related art, in the technical solutions of the present disclosure, the plurality of pixel circuits are arranged with the N1 pixel circuits sharing the same first common line to receive the power-supply voltage signal, so as to reduce the number of the first common lines in the display device, the complexity of arranging the lines, and the parasitic capacitance between the lines. Further, the signal interference between the lines and the space occupied by the lines are reduced. In addition, since the first common number is negatively correlated to any of the characteristic parameter of the thin-film field-effect transistor of each of the pixel circuits, and the current in one of the N1 pixel circuits, and the resistance of the power-supply voltage signal line between the adjacent pixel circuits in the N1 pixel circuits, and the characteristic parameter of the thin-film field-effect transistor is positively correlated to the channel width-to-length ratio of the thin-film field-effect transistor, the first common number may be determined based on the above correlations. N1 is greater than 2 and not greater than the first common number, so as to avoid the occurrence of the pixel circuit having the greater difference in the length of the line configured to be connected to the same first common line from the other pixel circuits, in the pixel circuits connected to the same first common line. The greater difference in the resistance of the line due to the greater difference in the length of the line, which results in the non-uniformity of the power-supply voltage signal received by each of the N1 pixel circuits 11, may be further avoided. In this way, in the present disclosure, the number of the first common lines is reduced and other negative effects caused by reducing the number of the first common lines are avoided, improving the display effect of the display device.

The above is only an implementation of the present disclosure, and is not intended to limit the scope of the present disclosure. Any equivalent structure or equivalent process transformation based on the contents of the specification and the accompanying drawings, or any direct or indirect application in other related technical fields, is included in the scope of the present disclosure.

What is claimed is:

1. A display driving circuit, comprising a plurality of pixel circuits, wherein a data terminal of each of the pixel circuits is connected to a corresponding data line, the data line is configured to provide a data signal; a scanning gate terminal of each of the pixel circuits is connected to a corresponding gate line, the gate line is configured to provide a gate signal; power-supply terminals of N1 pixel circuits of the pixel circuits are all connected to a same first common line, the first common line is configured to provide a power-supply voltage signal, and N1 is greater than 2 and not greater than a first common number;

wherein the first common number is negatively correlated to any of a characteristic parameter of a thin-film field-effect transistor of each of the pixel circuits, and a current in one of the N1 pixel circuits, and a resistance of a power-supply voltage signal line between adjacent pixel circuits in the N1 pixel circuits, and the characteristic parameter of the thin-film field-effect transistor is positively correlated to a channel width-to-length ratio of the thin-film field-effect transistor.

2. The display driving circuit according to claim 1, wherein the characteristic parameter of the thin-film field-effect transistor of each of the pixel circuits is positively correlated to a mobility of the thin-film field-effect transistor and a construction capacitance of the thin-film field-effect transistor, respectively.

3. The display driving circuit according to claim 2, wherein the characteristic parameter of the thin-film field-effect transistor is a quotient obtained by dividing a fourth value by a length of a channel of the thin-film field-effect transistor, and the fourth value is a product of the mobility of the thin-film field-effect transistor, a width of a channel of the thin-film field-effect transistor, and the construction capacitance of the thin-film field-effect transistor.

4. The display driving circuit according to claim 1, wherein the first common number is a quarter power of a first value, the first value is a quotient obtained by dividing a first preset constant by a second value, the second value is a product of the characteristic parameter of the thin-film field-effect transistor of each of the pixel circuits and a third value, and the third value is a quadratic of a product of the resistance of the power-supply voltage signal line between the adjacent pixel circuits in the plurality of pixel circuits and the current of the pixel circuit.

5. The display driving circuit according to claim 4, wherein the first common number is a value determined based on a first calculation formula, and the first calculation formula is:

$$\begin{cases} n_1 = \left(\dfrac{H_1}{k \times (I \times R_1)^2}\right)^{\frac{1}{4}} \\ k = \mu \times \dfrac{W}{L} \times C \end{cases}$$

wherein $n_1$ is the first common number, $H_1$ is the first preset constant, k is the characteristic parameter of the thin-film field-effect transistor, $R_1$ is the resistance of the power-supply voltage signal line between the adjacent pixel circuits in the plurality of pixel circuits, μ is a mobility of the thin-film field-effect transistor, W is a width of a channel of the thin-film field-effect transistor, L is a length of the channel of the thin-film field-effect transistor, and C is a construction capacitance of the thin-film field-effect transistor.

6. The display driving circuit according to claim 4, wherein the first preset constant is positively correlated to the current of each of the pixel circuits, and is negatively correlated to a current fluctuation value between the adjacent pixel circuits.

7. The display driving circuit according to claim 6, wherein the current fluctuation value between the adjacent pixel circuits is a current difference value between the adjacent pixel circuits, and the current difference is 2%-3% of the current in the pixel circuit.

8. The display driving circuit according to claim 6, wherein the first preset constant is in a range of 0.08-0.12.

9. The display driving circuit according to claim 1, wherein receiving terminals of an initialization signal of N2 pixel circuits of the pixel circuits are all connected to a same second common line, and the second common line is configured to provide the initialization signal, and N2 is greater than 2 and not greater than a second common number;

wherein the second common number is negatively correlated to any of the characteristic parameter of the thin-film field-effect transistor of each of the pixel circuits, and a current in one of the N2 pixel circuits, and a resistance of a initialization signal line between adjacent pixel circuits in the N2 pixel circuits, and the characteristic parameter of the thin-film field-effect transistor is positively correlated to the channel width-to-length ratio of the thin-film field-effect transistor.

10. The display driving circuit according to claim 9, wherein the characteristic parameter of the thin-film field-effect transistor of each of the pixel circuits is positively correlated to a mobility of the thin-film field-effect transistor and a construction capacitance of the thin-film field-effect transistor, respectively.

11. The display driving circuit according to claim 1, wherein the pixel circuit comprises:

a data-writing circuit, an input terminal of the data-writing circuit being configured to receive a data signal;

a first light-emitting control circuit, an input terminal of first light-emitting control circuit being configured to receive a power-supply voltage signal;

a second light-emitting control circuit, an input terminal of the second light-emitting control circuit being connected to an output terminal of the data-writing circuit;

a driving circuit, an input terminal of the driving circuit being connected to an output terminal of the first light-emitting control circuit, and an output terminal of the driving circuit being connected to the input terminal of the second light-emitting control circuit;

a light-emitting circuit, an output terminal of the second light-emitting control circuit being connected to an input terminal of the light-emitting circuit, and an output terminal of the light-emitting circuit being configured to receive a ground voltage signal;

an initialization circuit, an input terminal of the initialization circuit being configured to receive an initialization signal, a second output terminal of the initialization circuit being connected the input terminal of the light-emitting circuit;

a storage circuit, a first output terminal of the initialization circuit being connected to an input terminal of the storage circuit, and a second output terminal of the storage circuit being connected to a driving terminal of the driving circuit; and a switch circuit, an input terminal of the switch circuit being connected to a first output terminal of the storage circuit, and an output terminal of the switch circuit being connected to the input terminal of the driving circuit.

12. A display device, comprising:

a light-emitting display device; and a display driving circuit, comprising a plurality of pixel circuits, wherein a data terminal of each of the pixel circuits is connected to a corresponding data line, the data line is configured to provide a data signal; a scanning gate terminal of each of the pixel circuits is connected to a corresponding gate line, the gate line is configured to provide a gate signal; power-supply terminals of N1 pixel circuits of the pixel circuits are all connected to a same first common line, the first common line is configured to provide a power-supply voltage signal, and N1 is greater than 2 and not greater than a first common number;

wherein the first common number is negatively correlated to any of a characteristic parameter of a thin-film field-effect transistor of each of the pixel circuits, and a current in one of the N1 pixel circuits, and a resistance of a power-supply voltage signal line between adjacent pixel circuits in the N1 pixel circuits, and the characteristic parameter of the thin-film field-effect transistor is positively correlated to a channel width-to-length ratio of the thin-film field-effect transistor.

13. The display device according to claim 12, wherein the characteristic parameter of the thin-film field-effect transistor of each of the pixel circuits is positively correlated to a mobility of the thin-film field-effect transistor and a construction capacitance of the thin-film field-effect transistor, respectively.

14. The display device according to claim 13, wherein the characteristic parameter of the thin-film field-effect transistor is a quotient obtained by dividing a fourth value by a length of a channel of the thin-film field-effect transistor, and the fourth value is a product of the mobility of the thin-film field-effect transistor, a width of a channel of the thin-film field-effect transistor, and the construction capacitance of the thin-film field-effect transistor.

15. The display device according to claim 12, wherein the first common number is a quarter power of a first value, the first value is a quotient obtained by dividing a first preset constant by a second value, the second value is a product of the characteristic parameter of the thin-film field-effect transistor of each of the pixel circuits and a third value, and the third value is a quadratic of a product of the resistance of the power-supply voltage signal line between the adjacent pixel circuits in the plurality of pixel circuits and the current of the pixel circuit.

16. The display device according to claim 15, wherein the first common number is a value determined based on a first calculation formula, and the first calculation formula is:

$$\begin{cases} n_1 = \left(\dfrac{H_1}{k \times (I \times R_1)^2}\right)^{\frac{1}{4}} \\ k = \mu \times \dfrac{W}{L} \times C \end{cases}$$

wherein $n_1$ is the first common number, $H_1$ is the first preset constant, k is the characteristic parameter of the thin-film field-effect transistor, $R_1$ is the resistance of the power-supply voltage signal line between the adjacent pixel circuits in the plurality of pixel circuits, μ is a mobility of the thin-film field-effect transistor, W is a width of a channel of the thin-film field-effect transistor, L is a length of the channel of the thin-film field-effect transistor, and C is a construction capacitance of the thin-film field-effect transistor.

17. The display device according to claim 16, wherein the first preset constant is positively correlated to the current of each of the pixel circuits, and is negatively correlated to a current fluctuation value between the adjacent pixel circuits.

18. The display device according to claim 17, wherein the current fluctuation value between the adjacent pixel circuits is a current difference value between the adjacent pixel circuits, and the current difference is 2%-3% of the current in the pixel circuit.

19. The display device according to claim 17, wherein the first preset constant is in a range of 0.08-0.12.

20. The display device according to claim 12, wherein receiving terminals of an initialization signal of N2 pixel circuits of the pixel circuits are all connected to a same second common line, and the second common line is configured to provide the initialization signal, and N2 is greater than 2 and not greater than a second common number;

wherein the second common number is negatively correlated to any of the characteristic parameter of the thin-film field-effect transistor of each of the pixel circuits, and a current in one of the N2 pixel circuits, and a resistance of a initialization signal line between adjacent pixel circuits in the N2 pixel circuits, and the characteristic parameter of the thin-film field-effect transistor is positively correlated to the channel width-to-length ratio of the thin-film field-effect transistor.

* * * * *